United States Patent [19]

Takahashi

[11] 4,153,311

[45] May 8, 1979

[54] SECTIONAL UNIT FURNITURE ASSEMBLY

[76] Inventor: Tadao Takahashi, Nishiageo Daini Danchi 3-9-203, No. 77-1, Ooaza Koshikiya, Ageo-shi, Saitama-ken, Japan

[21] Appl. No.: 858,336

[22] Filed: Dec. 7, 1977

[30] Foreign Application Priority Data

Nov. 22, 1977 [JP] Japan ..... 52-157101[U]

[51] Int. Cl.[2] ..... A47B 87/00

[52] U.S. Cl. ..... 312/107; 312/111; 312/195; 312/257 R; 108/111; 211/186

[58] Field of Search ..... 312/111, 107, 257 R, 312/257 SK, 257 A, 257 SM, 108, 198, 195; 108/111; 211/186

[56] References Cited

U.S. PATENT DOCUMENTS

| | | | |
|---|---|---|---|
| 1,192,207 | 7/1916 | Kahn | 312/111 |
| 2,366,677 | 1/1945 | Rosenthal | 108/111 |
| 2,825,101 | 3/1958 | Rubenstein | 108/111 |
| 3,069,216 | 12/1962 | Vaeth | 211/186 |
| 3,298,329 | 1/1967 | Carstens, Jr. et al. | 312/257 R |
| 3,713,717 | 1/1973 | Hafner | 312/195 |
| 3,730,601 | 5/1973 | Misenheimer | 312/111 |
| 3,790,241 | 2/1974 | Messina | 312/111 |

FOREIGN PATENT DOCUMENTS

| | | | |
|---|---|---|---|
| 45-93218 | 7/1975 | Japan | 312/111 |
| 45-112215 | 9/1975 | Japan | 312/111 |
| 45-74280 | 7/1976 | Japan | 312/111 |

*Primary Examiner*—Victor N. Sakran
*Attorney, Agent, or Firm*—Lane, Aitken & Ziems

[57] ABSTRACT

There is described a sectional unit furniture assembly which employs at least one connecting board for interconnecting at least two juxtaposed sectional units or columns of stacked sectional units, the connecting board having at opposite ends shelf portions capable of interlocking with side and rear wall sections of the respective units and a connecting portion interconnecting the two juxtaposed units or columns at a predetermined space from each other.

2 Claims, 7 Drawing Figures

SECTIONAL UNIT FURNITURE ASSEMBLY

BACKGROUND OF THE INVENTION

This invention relates to a multiple-purpose unit furniture assembly, and more particularly to a sectional unit furniture assembly which consists of a number of two-dimensionally connected units.

In Japanese Utility Model Publication No. 50-24900, I have disclosed a stacking type sectional unit furniture which is basically composed of a pair of spaced side wall sections, a rear wall section and a number of shelf boards. The unit can be assembled simply by interlocking notched grooves which are provided in the respective sections and shelf boards. The side and rear wall sections of the unit are provided with joint means for connection with an overlying or underlying unit when a number of similar units are used in a stacked form.

The unit furniture of this sort has inherent drawbacks in that the respective units can be connected only in the vertical direction and the column of the stacked units looses stability as the number of units increases.

It is an object of the present invention to provide a sectional unit furniture assembly employing means for two-dimensionally connecting the furniture units of the type mentioned above. It is a more particular object of the present invention to provide a sectional unit furniture assembly employing a connecting board which can interconnect at least two juxtaposed units of sectional furniture or columns of stacked units while strengthening the stability of the assembly as a whole.

It is another object of the invention to provide a sectional unit furniture assembly in which the respective units can be arranged two-dimensionally and in various ways to fit the space which is available for placing the furniture.

SUMMARY OF THE INVENTION

According to the present invention, there is provided a sectional unit furniture assembly comprising at least two juxtaposed sectional units each consisting of at least a pair of opposingly spaced side wall sections, a rear wall section and a shelf section, and a connecting board for interconnecting the juxtaposed units, each one of the side wall sections consisting of a rectangular board having a vertical interlocking groove notched into its upper edge close to and parallel with its rear edge, a joint groove notched into its lower edge in vertical alignment with the interlocking vertical groove in the upper edge, and a number of horizontal grooves notched into its front edge in predetermined parallel spaced relationship, the rear wall section consisting of a rectangular board with laterally extending wing portions at opposite sides, each wing having in its lower portion a vertical groove for interlocking engagement with the vertical grooves in the respective side wall sections and a number of horizontal slots provided along its vertical axis in the same parallel spaced relationship as the horizontal grooves at the front edge of the side wall section, the shelf section consisting of a rectangular board with, at opposite ends, laterally extending wing portions, a pair of parallel grooves notched into its wing portions and spaced from each other by the same distance as the vertical grooves in the rear wall section and a rearwardly projecting tab at an intermediate point of its rear edge, the shelf section being joined with the side and rear wall sections by interlocking the notched grooves in its wing portions with the opening horizontal grooves at the front edges of the side wall sections and inserting the rearwardly extending tab into one of the horizontal slots in the rear wall section, and the connecting board having at each end at least one shelf portion of a structure similar to the afore-mentioned shelf section and a connecting portion interconnecting inner wings of the two shelf portions.

The above and other objects, features and advantages of the invention will become apparent from the following description and the appended claims, taken in conjunction with the accompanying drawings which show, by way of example, one preferred embodiment of the invention.

DETAILED DESCRIPTION OF THE INVENTION

Figure 1:
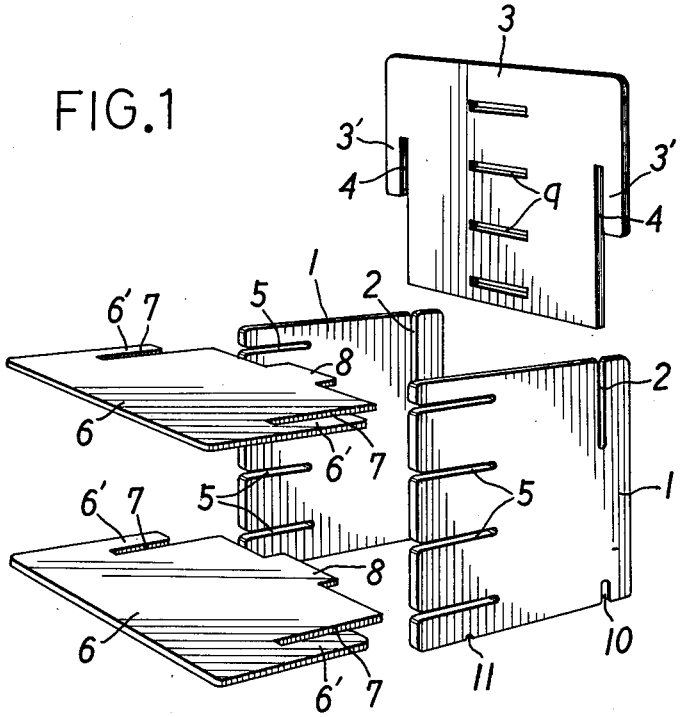
FIG. 1 is an exploded perspective view of a stacking type sectional unit furniture according to my prior invention.
Figure 2:
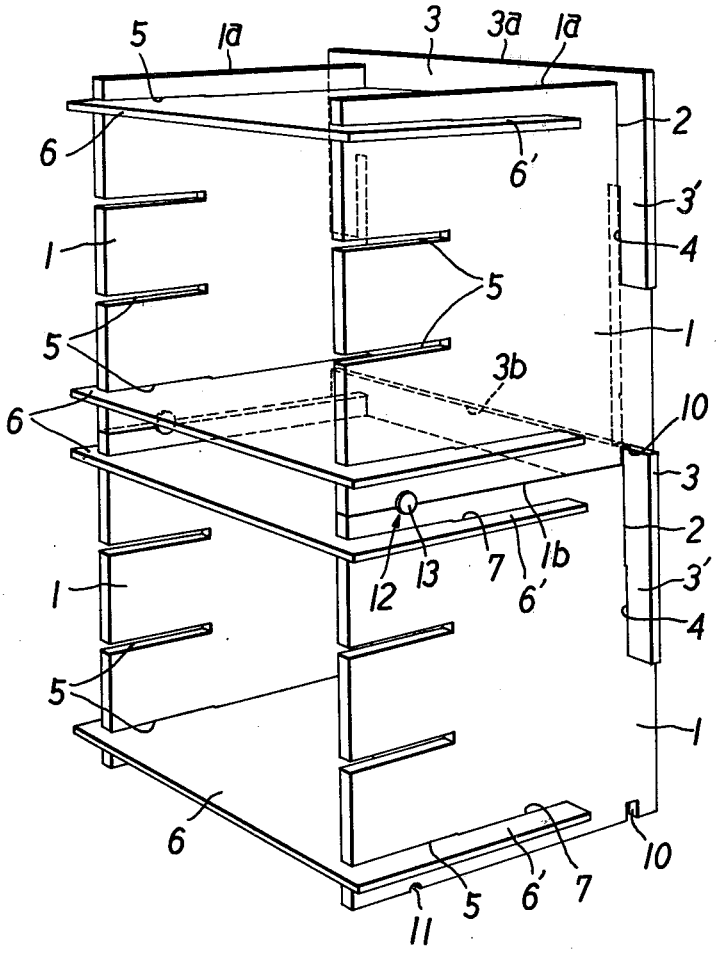
FIG. 2 is a perspective view showing two units of the same sectional furniture in stacked state.

Referring now to the accompanying drawings, and first to FIGS. 1 and 2, there is shown a sectional unit furniture as described in Japanese Utility Model Publication No. 50-24900 previously mentioned herein. The unit furniture includes a pair of spaced side wall sections 1 each having a straight vertical groove 2 running inwardly from its upper edge close to and parallel with its rear edge. The side wall sections 1 are joined with a rear wall section 3 by interlocking the grooves 2 with a pair of vertical grooves 4 which are provided in laterally extending wing portions 3' at opposite sides of the rear wall section 3.

The side wall sections are further provided with a number of straight horizontal grooves 5 which run inwardly from the respective front edges in predetermined parallel spaced relationship. A shelf section 6 is joined with the side wall sections 1 by interlocking a pair of parallel grooves 7, which are provided in laterally extending wing portions 6*c* of the shelf section 6, with opposing grooves 5 at a suitable level of the side wall sections 1. The grooves 7 are spaced from each other by the same distance as the paired parallel grooves 4 in the side wings 3' of the rear wall section 3. The shelf section 6 is provided with a rear tab 8 at an intermediate point of its rear edge, which is to be inserted in one of elongaged slots 9 of the rear wall section when the grooves 5 and 7 of the side wall sections 1 and shelf section 6 are fully interlocked with each other. The side wall section 1 and the rear wall section 3 are of the same length but their interlocking grooves 2 and 4 are formed in such lengths that, when assembled, the upper edge 3*a* of the rear wall section 3 projects above the upper edges 1*a* of the respective side wall sections 1 by a length corresponding to a joint notch 10 which is provided in the lower edge 1*b* of each side wall section in vertical alignment with the interlocking groove 2. Therefore, when a number of similar units are stacked one on another, the projecting upper edge of the rear wall section of an underlying unit fits in the joint notches of an overlying unit as shown in FIG. 2.

Figure 3:
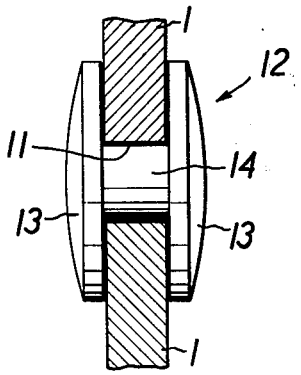
FIG. 3 is a diagrammatic view of a fitting joint for fixing the connected edges of the upper and lower units.

In addition to the joint notch 10, each side wall section 1 is provided with a small notch 11 at a suitable position on its lower edge for receiving a fitting joint member 12 which, as shown in FIG. 3 consists of a cylindrical body portion 14 and a pair of head portions 13 which are secured to the opposite ends of the body portion 14. When fitted in notches 11 of stacked units, the fitting joints 12 securely hold the connected edge portions of the upper and lower units from opposite sides by the heads 13. Therefore, with a column containing a number of stacked units, the projecting upper edge of the rear wall section of each unit is held in the joint notch 10 of an overlying unit to prevent relative positional deviations in the forward or rearward directions. On the other hand, the fitting joint 10 which firmly grips the connected edge portions of two adjoining units prevents their relative positional deviations in the sideward directions. The stacked units are thus held in vertically aligned positions with suitable stability.

However, the sectional furniture units of FIGS. 1 and 2 have inherent drawbacks in that they can be connected only in the vertical direction and loose stability when stacked in a greater number. In order to prevent their instabilization, it is necessary to machine the side wall sections with high precision, particularly the vertical dimensions in various portions and the finish of their joining end faces, resulting in increased production costs.

Figure 4:
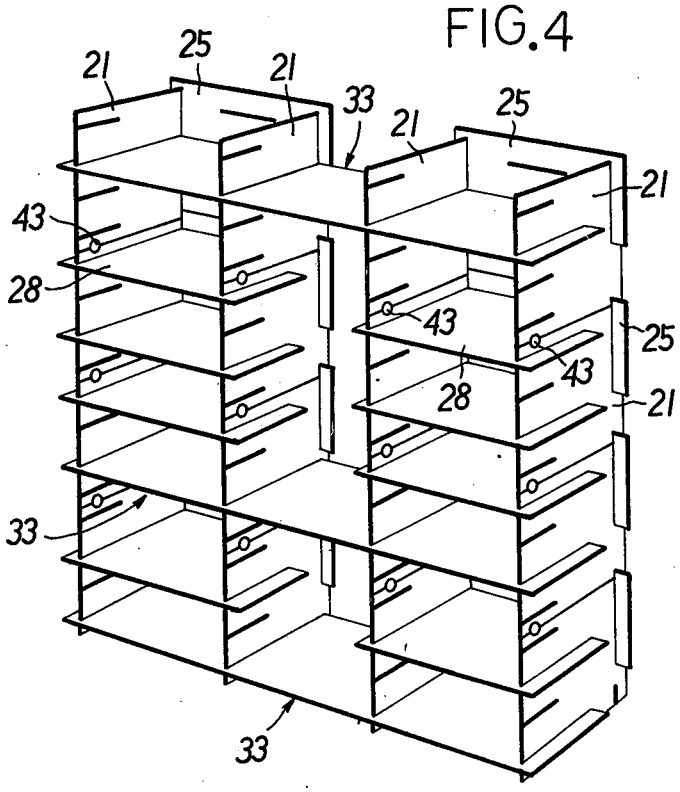
FIG. 4 is an exploded perspective view of a two-dimensional unit furniture assembly according to the present invention, incorporating two columns of stacked units.
Figure 5:
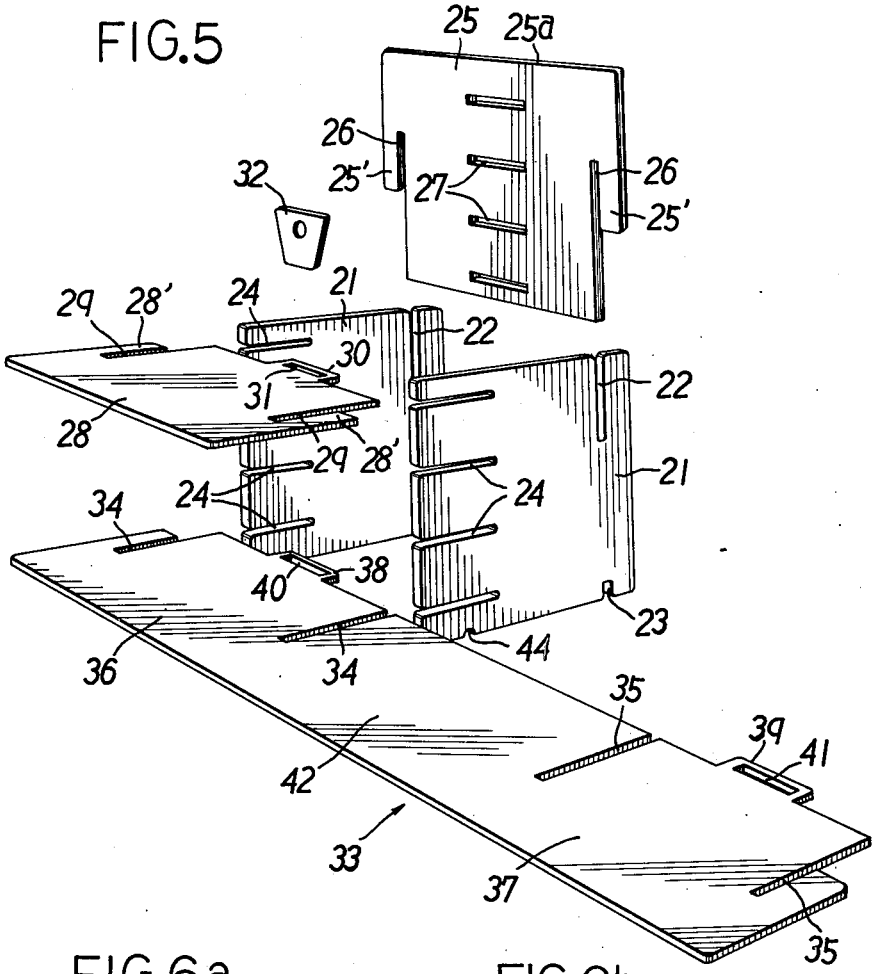
FIG. 5 is an exploded perspective view of one unit and a connecting board employed in the assembly of FIG. 4.

These drawbacks are overcome by the sectional unit furniture assembly according to the present invention. Referring to FIGS. 4 and 5, the sectional unit furniture of the invention includes at least two juxtaposed sectional units similar to the one shown in FIGS. 1 and 2, and a connecting board. More precisely, each unit has a pair of opposingly spaced side wall sections 21 each consisting of a rectangular board with a straight vertical groove 22 running inwardly from its upper edge close to and parallel with its rear edge, and a joint notch 23 notched into its lower edge in vertical alignment with the groove 22. The side wall section 21 is further provided with a number of horizontal grooves 24 which are cut into its front edge in a predetermined parallel spaced relationship.

The rear wall section 25 also consists of a rectangular board with a pair of parallel grooves 26 in the lower portions of its laterally extending wing portions 25'. The rear wall section 25 has, preferably along its vertical axis, a number of horizontal slots 27 in the same parallel spaced relationship as the horizontal grooves 24 in the side wall section 21. The rear wall section 25 is joined with the side wall sections 21 by interlocking the vertical grooves 26 of the rear section 25 with the vertical grooves 22 of the respective side sections 21. In the joined position, the upper edge 25*a* of the rear wall section 25 projects above the upper edges of the side wall sections 21 by a length corresponding to that of the joint notches 23 in the lower edges of the respective side wall sections 21. On the other hand, the lower edge of the joined rear wall section 25 terminates short of the lower edges of the side wall section 21 by the same length.

The sectional furniture assembly according to the invention employs two kinds of shelf sections. The first one is of a rectangular board 28 with a pair of parallel grooves 29 in the lower portiions of its laterally extending wing portions 28'. The grooves 29 are spaced from each other by the same distance as the vertical grooves 26 in the rear wall section 25. The shelf section 28 further has at the center of its rear edge a tab 30 with a wedge hole 31. To join the shelf section 28 with the side and rear wall sections 21 and 25, the grooves 29 are interlocked with the opposing grooves 24 on the respective side wall sections 21, inserting the tab 30 in one of the horizontal slots 27 of the rear wall piece 25 which is in level with the interlocked grooves 24. After joining the shelf section 28 with the side and rear walls in this manner, a wedge member 32 is placed in the wedge hole 31 to fix the joined shelf section 28 securely in position.

The other shelf type is a connecting board 33 which has at least two shelf portions 36 and 37 similar to the shelf section 28 at its opposite end portions or on the opposite sides of a connecting portion 42. The connecting board 33 therefore contains at least two pairs of parallel grooves 34 and 35 in the respective shelf portions 36 and 37. The grooves in each shelf portion are spaced from each other by the same distance as the parallel grooves 29 in the shorter shelf section 28. Similarly, rearwardly extending tabs 38 and 39 are provided at the rear edge of the respective shelf portions 36 and 37, preferably at a point intermediate between the parallel grooves 34 or 35, the rear tabs 38 and 39 each having a wedge hole 40 or 41 in which a wedge member 32 is placed after joining the connecting board with the side and rear wall sections 21 and 25. The length of the connecting portion between the paired grooves 34 and 35 is determined according to the desired width of the furniture as finally assembled or according to the width of the space which is available. For instance, the length of the connecting portion 42 may be identical to that of the shorter shelf section 38. In such a case, it becomes possible to insert a desired number of shorter shelf sections on the inwardly positioned side walls in the connected unit assembly as shown FIG. 4.

As illustrated in the assembly of FIG. 4, and FIG. 5 each side wall section of each unit has at its lower edge a notch 44 for receiving a fitting joint 43 similar to that previously mentioned, thereby firmly gripping the connected edge portions of the upper and lower units. Similarly, the fitting joint 43 has head portions secured to a cylindrical body which is to be fitted in the notch 44.

In order to increase the interlocking effect of the joined sections, it is preferred to provide pile coatings at least on the engaging surfaces of the joining sections and the wedge members, for instance, by planting short fibers electrostatically on those surfaces in the finishing stage of the respective component pieces of the unit. The planted short fibers on the engaging surfaces are frictionally pressed down upon joining the component sections, to have a grain in the inserted direction and therefore resist a force in the opposite direction by interlocking with the fibers on the opposing surfaces, preventing the joined sections from being disengaged from each other.

For assembling the furniture according to the invention, one rear wall section 25 is joined with a pair of spaced side wall sections 21 and the same procedure is repeated for a required number of times to make columns of stacked units with use of fitting joints 43 as shown in FIG. 4. The columns are then connected by a suitable number of elongaged connecting boards 33 by interlocking the notched parallel grooves 34 and 35 with the notched grooves 24 at the front edges of the side wall pieces of the respective columns. Thereafter, a suitable number of short shelf sections 28 are inserted in desired positions and the wedge members 32 are placed in the wedge holes in the rear tabs of the respective connecting boards 33 and shelf sections 28 to fix the joined pieces securely in position. Obviously, the furniture assembly is not restricted to the arrangement shown in FIG. 4 and may be arranged in different ways according to the purposes for which the furniture is to be used or to the spatial requirements of the place in which the furniture is to be installed.

The elongated connecting board 33 can connect a desired number of columns of stacked units by providing a suitable number of paired grooves at intervals along the length of the connecting portion. As seen in FIG. 4, the connecting boards contribute not only to connect the separate columns but to hold the whole assembly in an extremely stabilized condition. Particularly, the connecting board incorporated into the lower level of the assembly strengthens and stabilizes the base of the assembly, while a connecting board incorporated into an upper level of the assembly serves to stabilize the respective columns which otherwise become instable due to height.

Figure 6A:
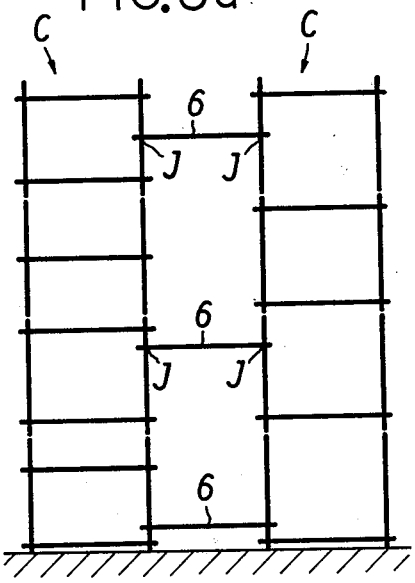
FIGS. 6*a* and 6*b* are diagrammatic views showing a two-dimensional unit furniture assembly formed without using a connecting board.
Figure 6B:
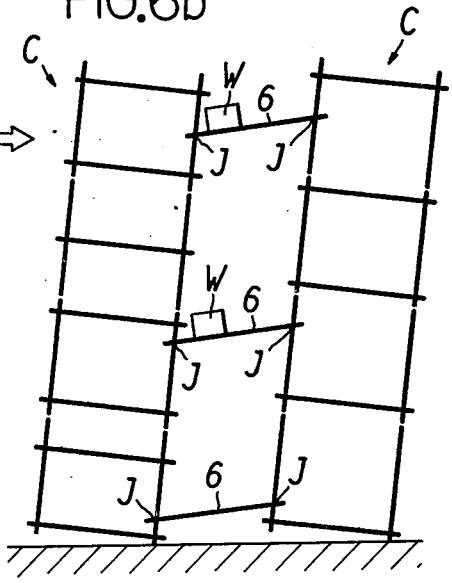

With an assembly having two columns C of stacked units which are connected only by short shelf sections as diagrammatically shown in FIG. 6A, the interlocked shelf and side wall sections are allowed to turn to some extent about the line of intersection at their joint J and therefore have a tendency to easily slant upon placing a heavy object W on a shelf at an upper level or upon application of sideward force (indicated by an arrow) as shown in FIG. 6B.

What is claimed is:

1. A sectional unit furniture assembly comprising:

at least two juxtaposed sectional units each consisting of at least a pair of opposingly spaced side wall sections, a rear wall section and a shelf section; and at least one connecting board for interconnecting the juxtaposed units;

each one of said side wall sections consisting of a rectangular board having a vertical interlocking groove notched into the upper edge close to and parallel with the rear edge, a joint groove notched into the lower edge in vertical alignment with said interlocking groove in the upper edge and a number of horizontal grooves notched into the front edge in a predetermined parallel spaced relationship;

said rear wall section consisting of a rectangular board with laterally extending wing portions at the opposite sides, said wing portions having a pair of parallel grooves for interlocking engagement with said vertical grooves in the respective side wall section, and a number of horizontal slots provided along the vertical axis in the same parallel spaced relationship as said horizontal grooves at the front edges of said side wall sections;

said shelf section consisting of a rectangular board with laterally extending wing portions at the opposite sides, a pair of parallel notched grooves formed in the wing portions and spaced from each other by the same distance as said parallel grooves of said rear wall section and a rearwardly extending tab at an intermediate point of the rear edge, said shelf section being joined with said side and rear wall sections by interlocking the notched grooves in the wing portions thereof with the opposing horizontal grooves at the front edges of said side wall sections and inserting the rearwardly extending tab into one of said horizontal slots in said rear wall section;

said connecting board having at least one shelf portion similar to said shelf section located at each end of the board, each said shelf portion including a pair of parallel grooves spaced from each other the same distance as the parallel grooves of the shelf section for interlocking each shelf portion with the opposing horizontal grooves at front edges of the side wall sections of each respective juxtaposed unit and further including a rearwardly extending tab between said parallel grooves which is inserted into one of the horizontal slots in the rear wall section of each respective juxtaposed unit, said connecting board further having a connecting portion integrally interconnecting the shelf portions and extending between the inner parallel grooves of each respective shelf portion, the length of said connecting portion being determined according to the desired width of the furniture assembly and serving as at least one additional shelf portion between the juxtaposed sectional units.

2. A sectional unit furniture assembly defined in claim 1, wherein the rearwardly extending tab of each of said shelf sections and said shelf portions of said connecting board is apertured, each said apertured tab portion receiving a wedge member after joining the shelf section and the shelf portions of the connecting board with said side and rear wall sections.

* * * * *